US009555660B1

(12) United States Patent
Fluharty et al.

(10) Patent No.: US 9,555,660 B1
(45) Date of Patent: Jan. 31, 2017

(54) REVERSIBLE-HINGE GREETING CARD WITH DUAL-ACTIVATED ELECTRONICS

(71) Applicant: HALLMARK CARDS, INCORPORATED, Kansas City, MO (US)

(72) Inventors: Charity Robin Fluharty, Kansas City, MO (US); Kaitlyn Marie Jerome, Kansas City, MO (US)

(73) Assignee: Hallmark Cards, Incorporated, Kansas City, MO (US)

( * ) Notice: Subject to any disclaimer, the term of this patent is extended or adjusted under 35 U.S.C. 154(b) by 0 days.

(21) Appl. No.: 15/178,252

(22) Filed: Jun. 9, 2016

(51) Int. Cl.
*B42D 15/02* (2006.01)
*G09F 1/04* (2006.01)
*B42D 15/04* (2006.01)

(52) U.S. Cl.
CPC ..... *B42D 15/022* (2013.01); *B42D 15/042* (2013.01); *G09F 1/04* (2013.01)

(58) Field of Classification Search
CPC ..... B42D 15/022; B42D 15/042; G09F 1/04
See application file for complete search history.

(56) References Cited

U.S. PATENT DOCUMENTS 2,915,842 A * 12/1959 Finnell ..... A63F 9/088 273/155
5,370,421 A * 12/1994 Kaiser ..... B42D 15/042 283/117
5,622,384 A * 4/1997 Bradley ..... B42D 15/042 281/2
5,815,964 A * 10/1998 Douglas ..... B42D 15/042 283/117
2006/0033326 A1* 2/2006 Wilk-Orescan ..... B42D 15/042 283/105
2010/0281720 A1* 11/2010 Tsai ..... G09F 1/04 40/124.13
2016/0114613 A1* 4/2016 Bogdanski ..... B42D 15/042 40/124.03

OTHER PUBLICATIONS

Digital photos of a dual opening greeting card manufactured by Hallmark Cards, Incorporated, in 2012. The greeting card had no electronics, 4 pages.

* cited by examiner

*Primary Examiner* — Gary Hoge
(74) *Attorney, Agent, or Firm* — Shook, Hardy & Bacon L.L.P

(57) ABSTRACT

A reversible hinge greeting card with an electronic component is provided. The greeting card has a card body with a plurality of panels. One of the panels is a front panel, one of the panels is a back panel, and one of the panels is an intermediary panel. The intermediary panel and a connecting band connect the front panel to the back panel, such that the greeting card can open from right to left or from left to right. An electronic component is integrated within the connecting band. The electronic component includes at least one switch operably connected to the front panel and at least one switch operably connected to the back panel.

20 Claims, 7 Drawing Sheets

REVERSIBLE-HINGE GREETING CARD WITH DUAL-ACTIVATED ELECTRONICS

BACKGROUND

The present invention relates generally to a greeting card. More particularly, embodiments of the present invention relate to a greeting card with electrical components that can be opened in more than one manner and can provide different activation responses accordingly.

Technology may be added to a greeting card to cause an event to occur when a consumer interacts with the greeting card. For example, an electronic component may be added to a card, or greeting card, in order to amplify the consumer experience of a papercraft only format. Such an enhanced greeting card experience may be pleasing to consumers. In this way a consumer may present a greeting card in a more attractive, exciting, or personal manner. A greeting card which integrates an electronic component will allow a giver of a gift card to do so in such an attractive manner. Incorporating multiple electronic components into a gift card, however, may be unappealing to the eye and cause a greeting card to become too bulky. Therefore, there is a need to integrate a multifunctional electronic component into a greeting card in a discrete fashion.

BRIEF SUMMARY

This summary is provided to introduce a selection of concepts in a simplified form that are further described in greater detail below. This summary is not intended to identify key features or essential features of the claimed subject matter, nor is it intended to be used as an aid in determining the scope of the claimed subject matter.

In brief, and at a high level, this disclosure describes, among other things, a greeting card with an electronic module integrated into it for creating an enhanced consumer or recipient experience. The greeting card may have a reversible hinge design to allow the greeting card to open to the left or to the right, thus revealing two separate designs. Further, the integrated electronic module may have two separate switches which can each trigger activation of the electronic module. For example, one switch may be activated when the card is opened to the left and one switch may be activated when the card is opened to the right. In this way, for example, sound may be added to a papercraft format or a greeting card. The experience of receiving and opening the greeting card is thereby enhanced by the electronics.

Disclosed herein, in various embodiments, are greeting cards with an electrical component. In one embodiment, a reversible hinge greeting card contains a single electronics module. Two separate switches are provided and may activate the single electronic module which is integrated with the greeting card.

In an embodiment, a greeting card with an electronic component is provided, the greeting card includes: a card body having a plurality of panels, wherein one of the panels is a front panel and one of the panels is a back panel; a connecting band couples the front panel to the back panel, such that the greeting card can open from right to left or from left to right; and an electronic component integrated with the connecting band and including at least one switch connected to the front panel and at least one switch connected to the back panel.

In an embodiment, a greeting card is provided including: a card body having a plurality of panels, wherein one of the panels is a front panel, one of the panels is a back panel, and one of the panels is an intermediary panel; a connecting band couples the front panel to the back panel such that the greeting card can open from right to left or from left to right; and an electronic component adjacent the card body and having a first switch activated by the front panel and a second switch activated by the back panel.

In an embodiment, a single electronic (e.g. sound) module is enclosed within a connecting band which functions as a link through a paneled card body and thus allowing the card to open two separate ways. The electronic module may be connected to two separate switches. A first switch is triggered when the card is opened from right to left, thereby activating the electronic module, and a second switch, slipped through an aperture in the connecting band structure, is triggered when the card is opened in the opposite direction (i.e., from left to right).

Additional objects, advantages, and novel features of the invention will be set forth in part in the description which follows, and in part will become apparent to those skilled in the art upon examination of the following, or may be learned by practice.

The above described and other features are exemplified by the following figures and detailed description.

BRIEF DESCRIPTION OF THE SEVERAL VIEWS OF THE DRAWINGS

The features of the invention noted above are explained in more detail with reference to the exemplary embodiments illustrated in the attached drawing figures, in which like reference numerals denote like elements, in which FIGS. 1-12 illustrate an embodiment of the present invention, and in which:

FIG. 1 is a front perspective view of a hinged greeting card in accordance with an embodiment of the present invention in a closed position;

FIG. 2 is a front perspective view of the hinged greeting card of FIG. 1 in a partially opened position from right to left;

FIG. 3 is a perspective view of the hinged greeting card of FIG. 2 in a more fully opened position and illustrates the interior of the greeting card when opened from right to left;

FIG. 4 is a top perspective view of the hinged greeting card of FIG. 1 where front and back panels of the card have been moved apart to illustrate the assembly of a hinged greeting card;

FIG. 5 is an elevation view of an unfolded blank that can be configured to form a card body of the greeting card of FIG. 1;

FIG. 6 is a perspective view of the blank of FIG. 5 in a first partially folded position;

FIG. 7 is a perspective view of the blank of FIG. 6 in a second and more fully folded position;

FIG. 8 is an elevation view of an unfolded blank that can be configured to form a connecting band of the greeting card of FIG. 1;

FIG. 9 is a perspective view of the connecting band of FIG. 8 in a folded position;

FIG. 10 is a schematic view of one possible embodiment of an electronic component for coupling with the greeting card of FIG. 1;

FIG. 11 is an elevation view of the greeting card of FIG. 1 fully opened from right to left (i.e., similar to FIG. 3) to reveal a first interior with a portion of the connecting band folded down to reveal portions of the exemplary electronic component of FIG. 10; and FIG. 12 is an elevation view of the greeting card of FIG. 1 fully opened from left to right with a portion of the connecting band folded down to reveal additional portions of the exemplary electronic component of FIG. 10.

DETAILED DESCRIPTION

Figure 1:
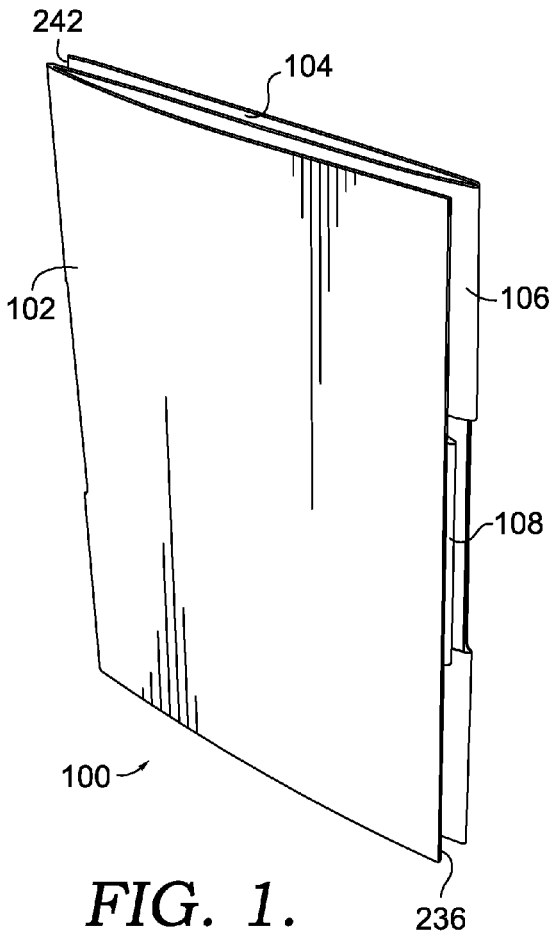

The subject matter of the present invention is described with specificity herein to meet statutory requirements. However, the description itself is not intended to limit the scope of the invention. Rather, the claimed subject matter may be embodied in other ways to include different elements, or combinations of elements, similar to those described in this disclosure, in conjunction with other present or future technologies, and still be within the scope of the present invention.

The greeting card described herein is designed to combine a greeting card with an electronic component to create an exciting and interactive greeting card. In its simplest terms, the present invention may be referred to as a reversible hinge greeting card with an electronic component. The greeting card is designed to combine a folded greeting card and an electronic component to create an attractive presentation and experience for a consumer or the recipient of such a greeting card. Various embodiments of a greeting card are described herein.

Embodiments of the present invention are directed to a reversible hinge greeting card. A reversible hinge greeting card may further be combined with an electronic component. By utilizing an electronics module one may add audio or visual effects or both to a traditional format greeting card. Further by utilizing a "reversible-hinge" design multiple designs can be incorporated into the card. In a broad aspect, an embodiment of a reversible hinge greeting card comprises a card body, a band, and an electronic component. An electronic component may comprise a plurality of switches, more specifically two switches. The band may be coupled to the card body to allow the greeting card to open in multiple directions (i.e., provide a reversible hinge mechanism for the greeting card). For example, the greeting card may open to the left or open to the right. In this fashion the greeting card, when opened to the left (i.e., in normal fashion), reveals one message or design. But, when opened from the right, or rotated 180° (i.e., flipped upside down) and opened to the left, it reveals a second message or design. The card body, band, and electronic component may be folded together into a compact arrangement where the band conceals the electronic component. The card body and the band may be made of the same materials, such as die-cut card stock, synthetic fiber materials, or the like.

The card body may be formed from die-cut card stock and include a plurality of panels, for example three panels, or more specifically five panels. It will be appreciated that the term "die-cut" may cover other types of cutting as well, for example laser, scissors, etc. Similarly, while "card stock" is referred to herein as an exemplary material, embodiments of a greeting card are not so limited, and "card stock" may cover other types of materials as well, for example plastics, thermoplastics, synthetic paper, etc. The panels may be separated by fold lines. It will be appreciated that the term "fold line" as used herein may cover a wide range of bends, scores, rules, creases, perforations, etc.

A card body may have a first side and a second side, and a top edge and a bottom edge. With respect to the first side, the card body may comprise a first panel, a second panel coupled to the first panel along a first fold line, a third panel coupled to the second panel along a second fold line, a fourth panel coupled to the third panel along a third fold line, and a fifth panel coupled to the fourth panel along a fourth fold line. The third panel may be referred to as a middle panel or a through panel. The fourth panel may be a front panel.

An image, display, print, lettering, or some combination of one of the foregoing may be printed on one or both sides of the card body, such that when the panels are folded together in a greeting card arrangement, the greeting card may have an image on the front, on the interior, and on the back.

By forming the card body and the band each from a single unitary piece of card stock, the die-cut card stock may be run through a printer prior to being cut and folded to print a design, coloring, pattern, sentiment, or other indicia on one or both sides of the card body.

A band may be coupled to the card body. The band comprises a band base, a first flap connected to the band base along a first fold line, a second flap connected to the band base along a second fold line, a first connecting tab connected to the band base along a first side fold line, and a second connecting tab connected to the band base along a second side fold line. The first and/or second flap may include tabs on any of the outer edges of the first and/or second flap with a surface of the tabs configured to be secured or affixed (e.g. with adhesive, double-sided tape, or other means) to the band base.

An image, display, print, or equivalent, may be printed on one or both sides of the band, such that when the band elements are folded together, and integrated with the card body, forming a greeting card arrangement, the greeting card may have a continuous image on the front, on the interior, and on the back, separately or together.

An electronic module may be provided and integrated with the card body and band to provide the amplified user experience. The electronic module may comprise a battery or other power source, wires, switches, a sound element (e.g., a speaker), a light element (e.g., an LED), a memory component, a motion component, or any combination of the foregoing. The electronic module may be operably connected to a switch and, in the present embodiment, two separate switches. The switches may be independent from each other and separately attached to the card body such that when the card is opened in either direction via the hinge, one of the switches will trigger the electronic module. Stated differently, two separate switches may trigger the single electronic module (e.g., a sound module). The electronic module may be integrated into the greeting card by being enclosed in the connecting band. The electronic module may be affixed to either side of the band base, and then obscured from view by the band flap. One switch may be affixed to the band base on the same side as the electronic module, and the other switch may be affixed to the opposite side of the band base.

Thus, there is provided a reversible-hinge greeting card design. In its simplest embodiment, the greeting card may be opened from right to left or left to right and have the ability to reveal two separate designs and provide two separate audio displays or visual displays or both. A single electronic module may be used which is operably connected to two separate switches that are affixed to the card body. The electronic module may be enclosed in a band, which provides the hinge mechanism for the greeting card. The band can be connected to the card body in a way that allows the hinge mechanism to operate and allows the card to open right to left or left to right. The band thus functions as a link through the card body to enable hinging of the assembled card. By being enclosed in the band, the electronic module is obscured from view when the greeting card is opened.

FIGS. 1-12 illustrate an embodiment of a greeting card according to aspects of the present invention. Alternate embodiments are contemplated, for example with more or fewer panels, different fold lines or patterns, different securing mechanisms, couplings, or attachments, or positioning of the various elements and are still within the scope of the present invention.

Referring now to the illustrated embodiment and initially to FIG. 1, a front perspective view of a hinged greeting card 100 constructed in accordance with an embodiment of the present invention is provided. The hinged greeting card 100 has a plurality of panels and includes a front panel 102, a back panel 104, and an intermediary panel 106. The intermediary panel 106 connects the front panel 102 and the back panel 104, such that they may form a stacked arrangement, as illustrated in FIG. 1.

Figure 2:
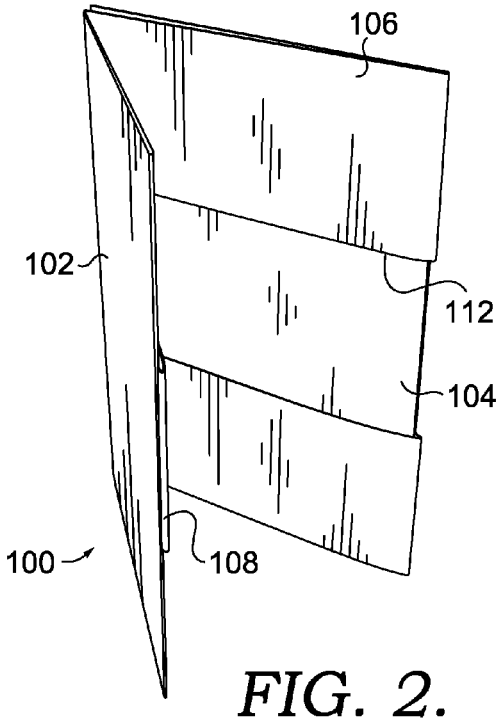

FIG. 2 illustrates a front perspective view of the hinged greeting card 100 of FIG. 1, but with the card 100 in a partially opened position from the right. The intermediary panel 106 has a section cutout, generally in its middle section. The cutout may be referred to as a window 112, such that the back panel 104 is visible through the window 112. The hinged greeting card 100 further includes a connecting band 108. The connecting band 108 is aligned in a complimentary fashion with respect to the window 112. The window can further be configured to receive the connecting band 108, as discussed in greater detail below.

Figure 3:
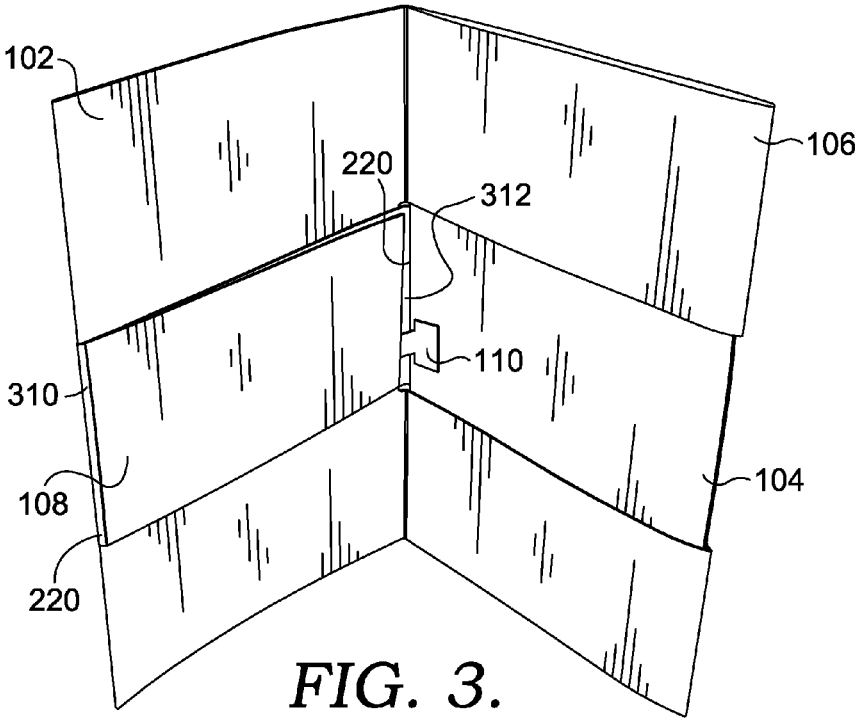

Turning now to FIG. 3, the hinged greeting card 100 is now illustrated in a mostly open position. The card 100, has been opened from right to left, as viewed in FIG. 1. With the card 100 almost fully open, a portion of a switch 110 is now visible. A portion of the switch 110 may be enclosed in the connecting band 108 and an end of the switch (i.e., the visible portion) is affixed to the back panel 104 through the window 112 in the intermediary panel 106.

Figure 4:
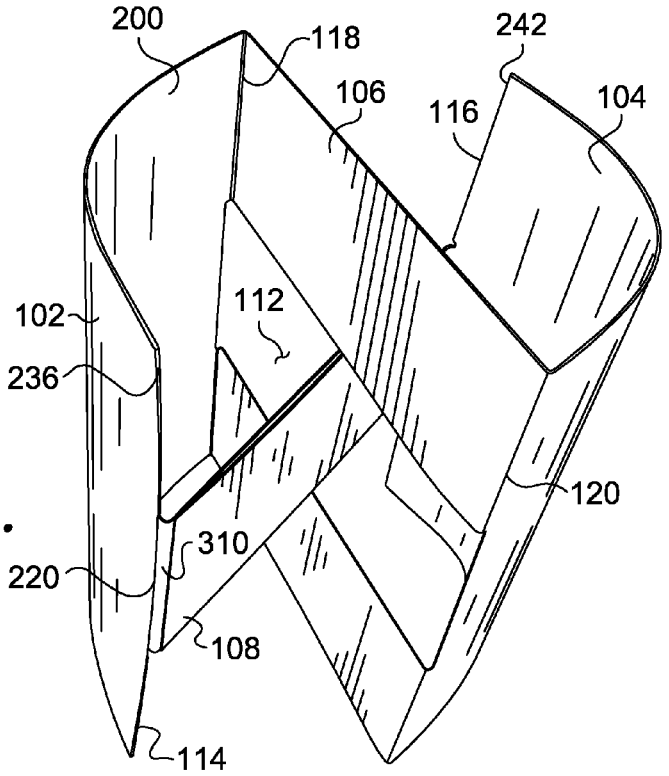

FIG. 4 is a view similar to FIG. 3, but with the front and back panels 102, 104 pulled away from each other to illustrate the relationship between the window 112 in the intermediary panel 106 and the connecting band 108. The connecting band 108 is aligned in a complimentary fashion with respect to the window 112 and the window receives the connecting band 108. In the illustrated embodiment, the connecting band 108 extends through the window 112 of the intermediary panel 106 and connects the front panel 102 and the back panel 104 together. The intermediary panel 106 and the connecting band 108 connect opposite side edges of the front panel 102 and the back panel 104. For example, the intermediary panel 106 connects the front panel inside edge 118 to the back panel inside edge 120 and the connecting band 108 connects the front panel outside edge 114 to the back panel outside edge 116. The intermediary panel 106 and the connecting band 108 cooperate to provide a reversible hinging action for the greeting card 100.

Figure 5:
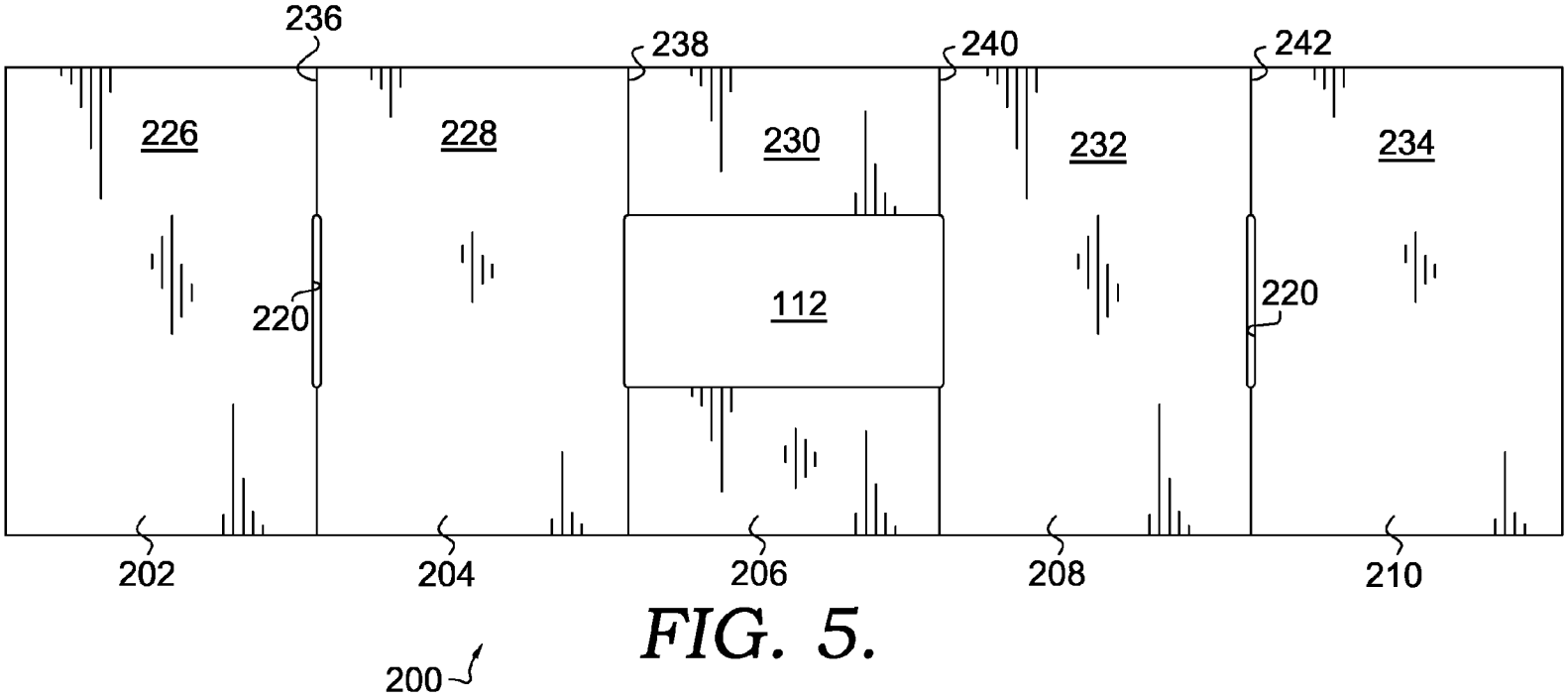

Referring to FIG. 5, a deconstructed flat view of a card body 200 is provided in accordance with an embodiment of the present invention. The card body 200 is formed from a single piece of card stock that is die-cut and provided with fold lines to define a plurality of panels, more specifically five panels. The panels include a first panel 202, a second panel 204, a through panel or third panel 206, a fourth panel 208, and a fifth panel 210. The panels may be generally the same height and width. The first panel 202 has a first side 226 and is coupled to the second panel 204 along a first fold line 236. The second panel 204 has a first side 228 and is coupled to the third panel 206 along a second fold line 238. The third panel 206 has a first side 230 and is coupled to the fourth panel 208 along a third fold line 240. The fourth panel 208 has a first side 232 and is coupled to the fifth panel 210, having a first side 234, along a fourth fold line 242. The third panel 206 includes the cutout or window 112 discussed above. The cutout or window 112 may be generally centered vertically on the third panel 206. The cutout or window 112 may extend the width of the third panel 206, from second fold line 238 to third fold line 240. Alternatively, and as illustrated, the cutout or window 112 may extend past second fold line 238 or third fold line 240 or both. The card body 200 further includes a cutout or slot 220 along the first fold line 236 that is generally aligned with the window 112. The card body 200 also includes a cutout or slot 220 along the fourth fold line 242 that is also generally aligned with the window 112. Alternatively, the slots 220 may slits along the first fold line 220 and the fourth fold line 220. According to this view, the card body 200 is lying flat, in a flat, unfolded configuration, such as just after the die-cutting process. This arrangement and the use of five panels allows a die cut blank to be passed through a printer to provide printing on all of the surfaces of the card body 200 when it is formed. This permits the card body 200 to be customizable and allow for any number of designs or pictures or lettering to be printed thereon.

Figure 6:
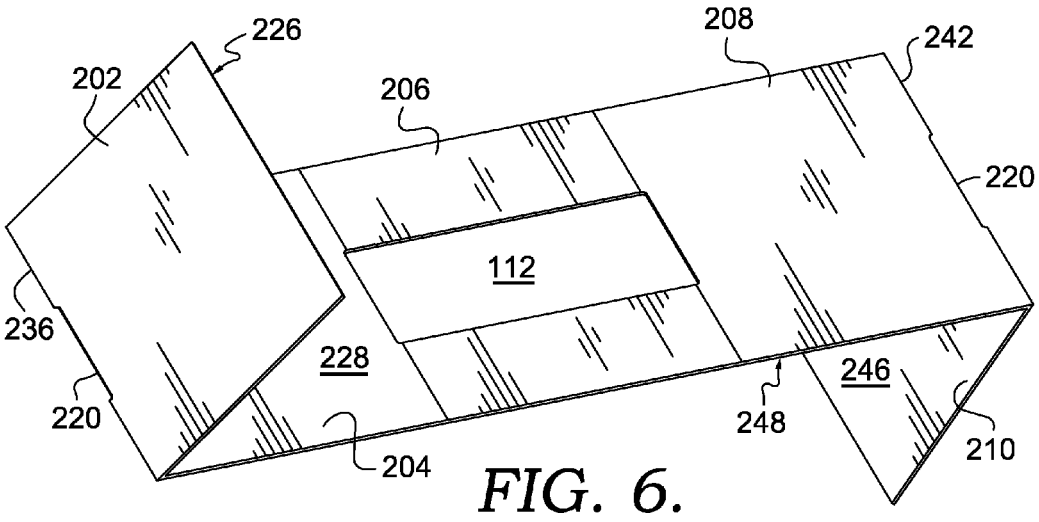
Figure 7:
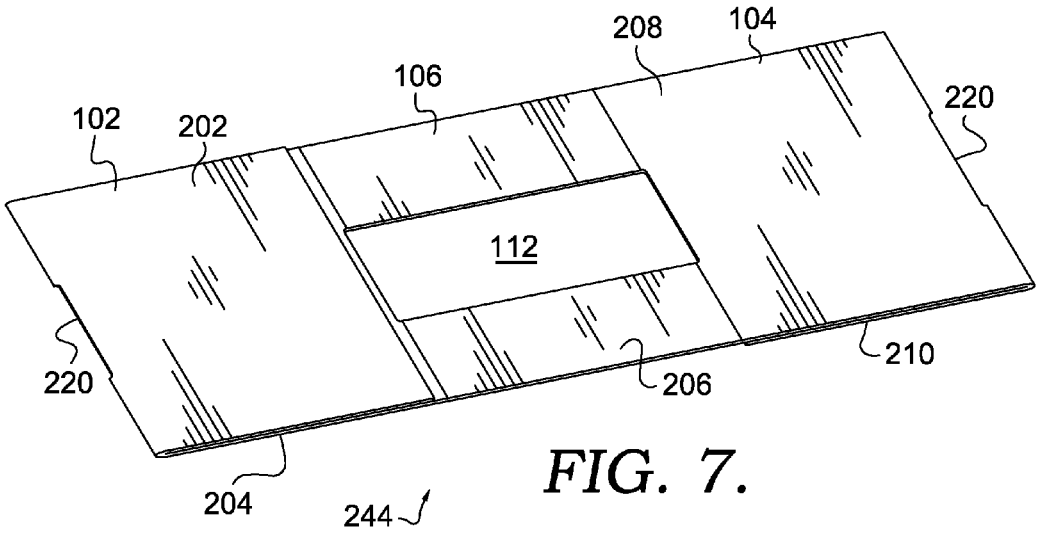

Referring now to FIGS. 6 and 7, perspective views of the card body 200 are provided showing the card body 200 various states of assembly. In FIG. 6, the panels 202 and 204, as well as panels 208 and 210, are folded toward each other until they result in the stacked arrangements illustrated in FIG. 7. Panel 202 is folded toward panel 204 along the first fold line 236. In this arrangement, the first panel first side 226 and the second panel first side 228 are facing each other, and their panel faces are preferably coupled together, e.g., by adhesive or other bonding or attachment means. Panel 210 is folded toward panel 208 along the fourth fold line 242. In this arrangement, a second side 246 of the fifth panel 210 is moved toward a second side 248 of the fourth panel 208 until they are facing each other. Their panel faces are preferably coupled together, e.g., by adhesive or other bonding or attachment means. This arrangement presents the appearance of a three panel greeting card, or the formed card body 244 illustrated in FIG. 7. In this arrangement, panels 202 and 204 thus form the greeting card front panel 102, and panels 208 and 210 thus form the greeting card back panel 104. Panel 206 thus becomes the intermediary panel 106, having the window 112.

Figure 8:
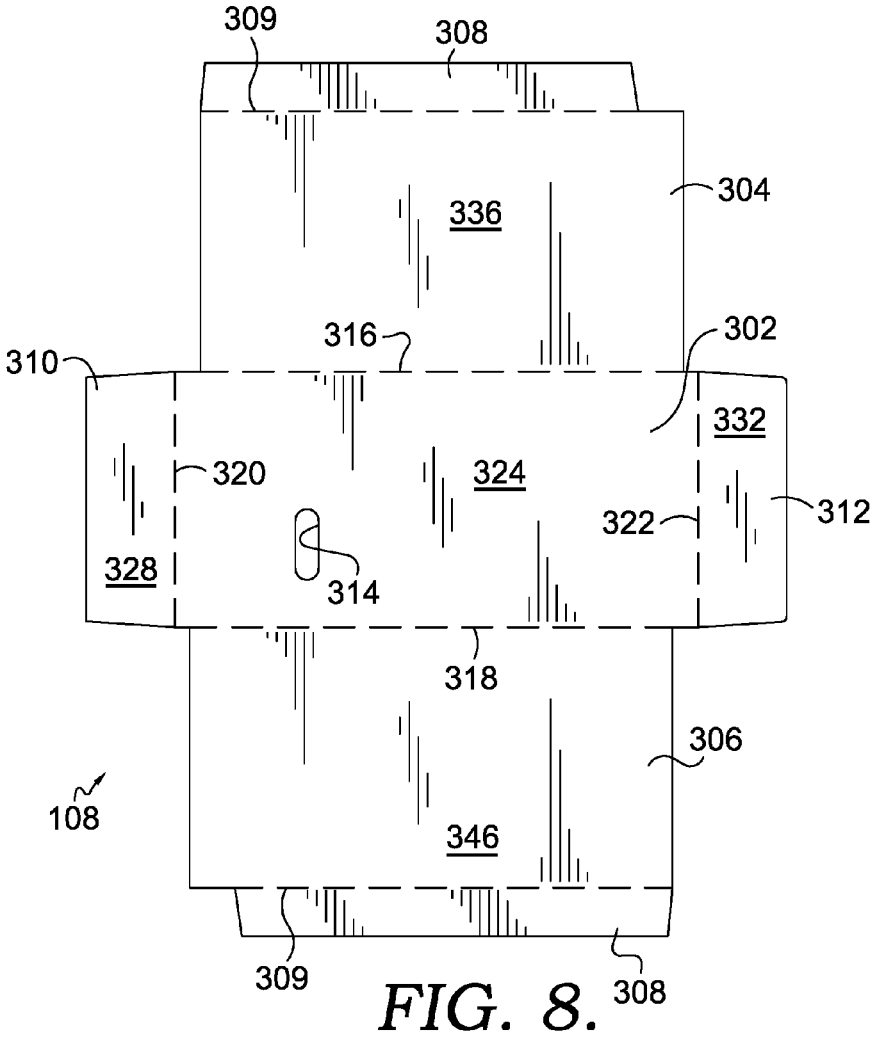

Referring to FIG. 8, a deconstructed flat view of a connecting band 108 is provided in accordance with an embodiment of the present invention. In the illustrated embodiment, the connecting band 108 is formed from a single piece of card stock that is die-cut and folded to provide a band base 302, a first flap 304, a second flap 306, a first connection tab 310, and a second connection tab 312. The band base 302 has a first side 324 and a second side 326 (not shown, but opposite the first side 324) and is coupled to the first flap 304 along a first fold line 316. The first flap 304 has a first side 336 and a second side (not shown, but opposite the first side 336), and may optionally be coupled to a flap tab 308 along a flap fold line 309. The band base 302 is coupled to the second flap 306 along a second fold line 318, which is parallel to and on an opposite edge of the band base 302 from the first fold line 316. The second flap has a first side 340 and a second side 342, and may optionally be coupled to a flap tab 308 along a flap fold line 309.

The band base 302 is coupled to the first connection tab 310 along a third fold line 320, which is generally perpendicular to the first fold line 316 and the second fold line 318. The first connection tab 310 has a first side 328 and a second side (not shown, but opposite first side 328). The band base 302 is coupled to the second connection tab 312 along a fourth fold line 322, which is generally perpendicular to the first fold line 316 and the second fold line 318 and distally located from the third fold line 320. The second connection tab 312 has a first side 332 and a second side (not shown, but opposite the first side 332). The band base 302 may also comprise an aperture 314. The aperture 314 may be generally situated anywhere on the band base 302. In the illustrated embodiment, the 314 is positioned towards one of the ends of the band base 302 (i.e., towards one of the connection tabs 310, 312).

Turning back momentarily to FIG. 4, the slot or slit 220 in the first fold line 236 of the card body 200 receives the first connection tab 310 of the connecting band 108. The first connection tab 310 passes through the slot or slit 220 and is secured by any known connection or attachment means (e.g., glue or tape) between first panel 202 and second panel 204 and to first side 226, first side 228, or both. Similarly, the slot or slit 220 in the fourth fold line 242 of the card body 200 receives the second connection tab 312 of the connecting band 108. The second connection tab 312 passes through the slot or slit 220 and is secured by any known connection or attachment means (e.g., glue or tape) between fourth panel 208 and fifth panel 210 and to second side 246, second side 248, or both.

The connection band 108 thus passes through the window 112 while attached to the front panel 102 and back panel 104. In its closed state, the elements of the hinged greeting card 100 form a stacked arrangement, as illustrated in FIG. 1. The card 100 can be opened from right to left (i.e., opening the card normally by the front panel 102) allowing the hinged greeting card 100 to be in a first open position when the front panel and the back panel are not generally parallel, as illustrated in FIG. 3. Alternatively, the card can be opened from left to right (i.e., opening the card opposite of a normal card) allowing the hinged greeting card 100 to be in a second open position when the front panel and the back panel are not generally parallel. This is the same as if the card were rotated 180° and opened right to left.

Figure 9:
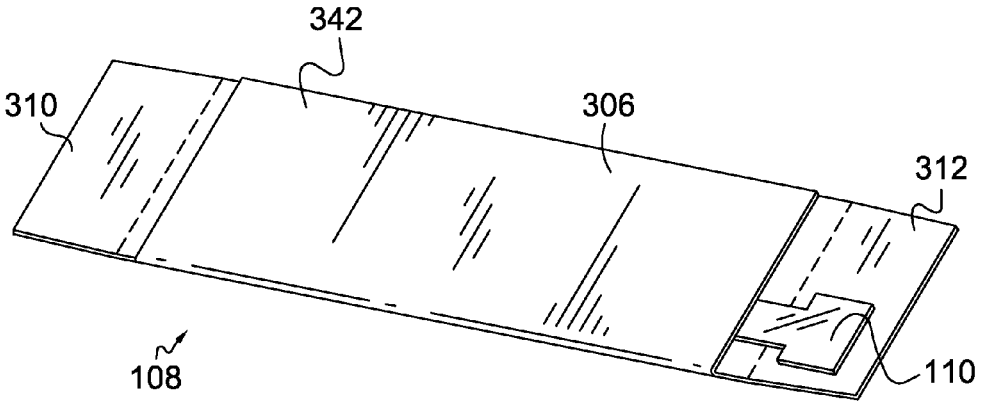

Referring to FIG. 9, an assembled view of the connecting band 108 is provided in accordance with an embodiment of the present invention. The band base 302, the first flap 304, and the second flap 306 have been folded together so that they form a generally stacked arrangement. First flap 304 was folded towards the band base 302 along the first fold line 316. The first flap first side 336 and the band base first side 324 were made to face each other. The first flap 304 and the band base 302 were coupled together (e.g., by direct adhesive) along the edge which is distally located from the first fold line 316, or through the use of a flap tab and adhesive in combination. Second flap 306 may be folded towards the band base 302 along the second fold line 318. The second flap second side and the band base second side 326 may face each other. The second flap 306 and the band base 302 may be coupled together (e.g., by direct adhesive) along the edge which is distally located from the second fold line 318, or through the use of a flap tab and adhesive in combination. In its generally stacked arrangement, the flaps of the connecting band obscure the faces of the band base 302 (i.e., first flap 304 is on one side of band base 302 and second flap 306 is on the other side the band base 302—a cross-section would reveal a flattened letter Z shape) and the aperture 314 located thereon.

Figure 10:
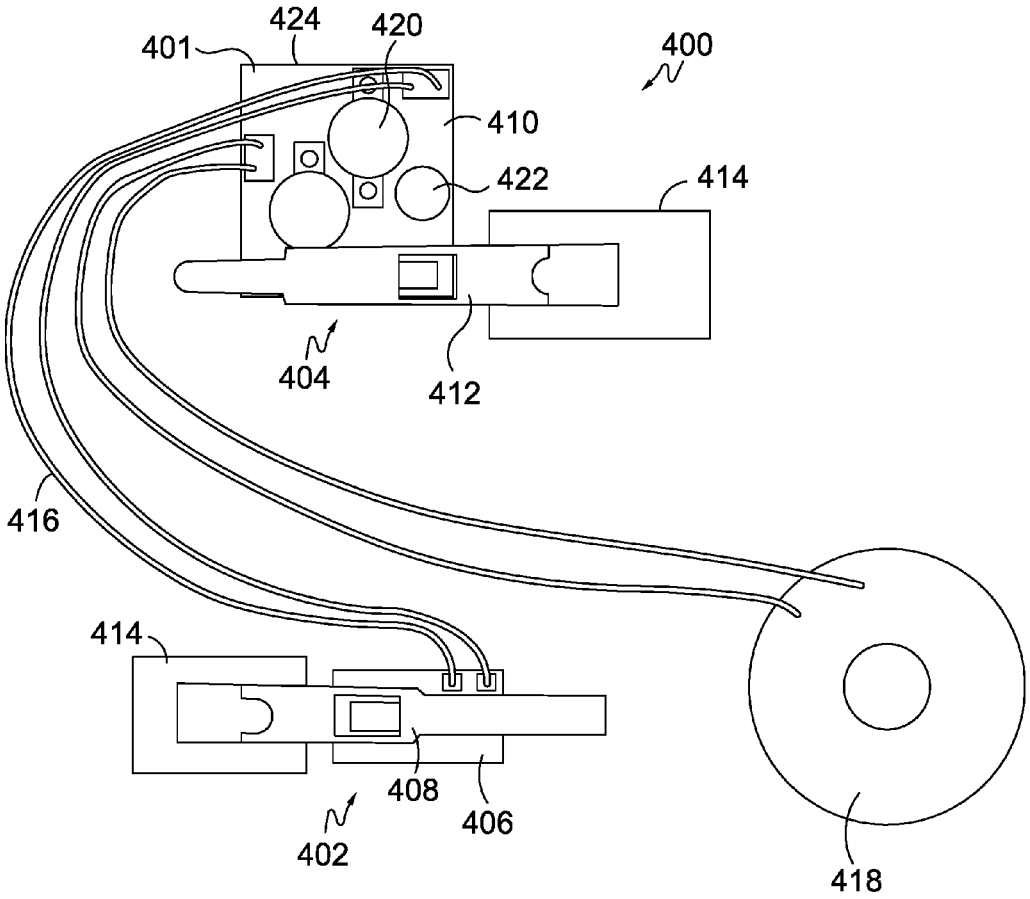

Referring to FIG. 10, an exemplary view of an electronic component 400 is provided in accordance with an embodiment of the present invention. The electronic component 400 may comprise an electronic module 401 (e.g., a sound module or audio playback device), a first switch 402, and a second switch 404. The electronic component 400 may also include several other electrical components, such as, for example, a speaker 418, batteries 420, and an integrated circuit or chip 422, some of which are placed on a printed circuit board 424. The electronic module 401 can store a plurality of audio files that may be triggered by the first switch 402 or the second switch 404.

The electronic module 401 can be electrically connected to the first switch 402 (e.g., by wires 416) and the second switch 404. The first switch 402 may comprise a first trigger (e.g., a contact switch) 406 and a first slider 408 and the second switch 404 may comprise a second trigger 410 and second slider 412. The sliders 408, 412 are movable between and apart from contacts of the triggers 406, 410 to selectively permit and prevent an electrical connection. The first trigger 406 and the first slider 408 are operably connected such that they can be enabled to initiate a first audio playback (e.g., when the hinged greeting card 100 is opened in a first direction). The second trigger 410 and the second slider 412 are operably connected such that they can be enabled to initiate a second audio playback (e.g., when the hinged greeting card 100 is opened in a second direction). The contact type slider switches illustrated are well known in the greeting card art and have been used for many years. Other types of switches may be used with the present invention.

Figure 11:
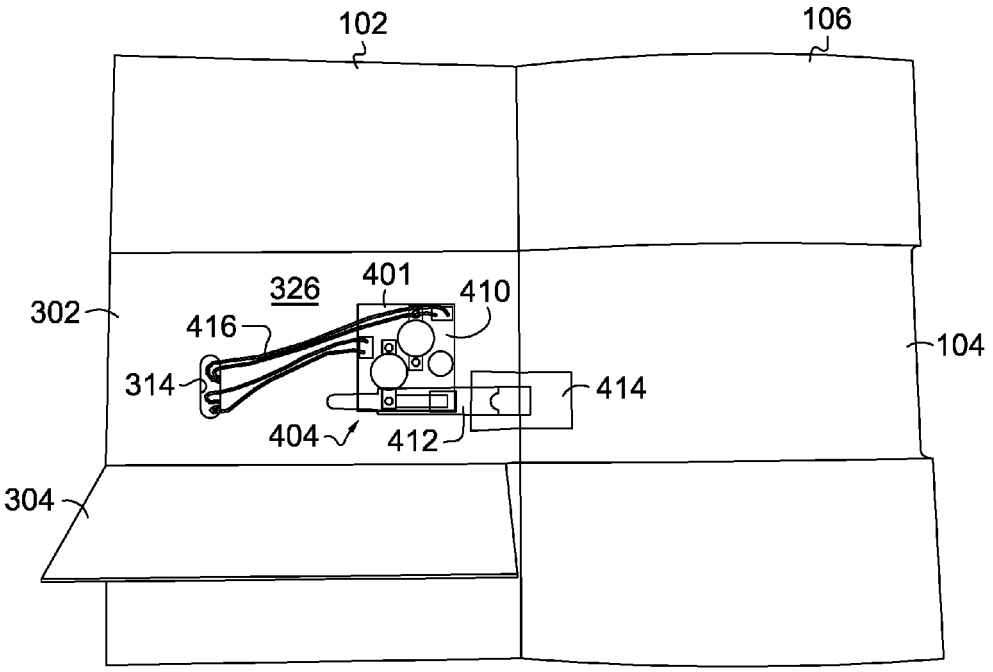
Figure 12:
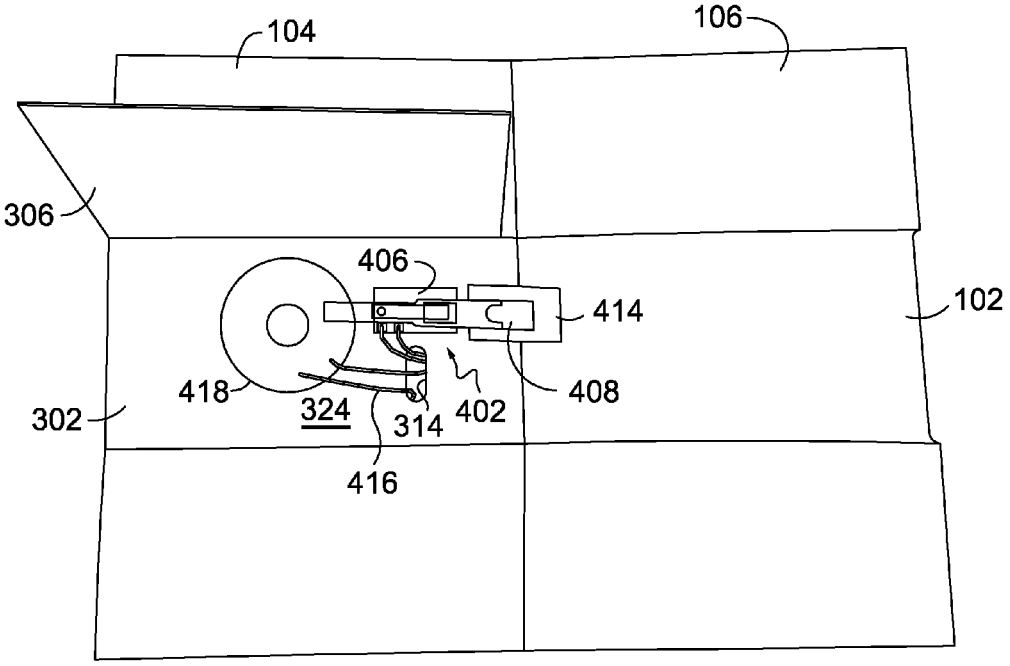

Referring to FIGS. 11 and 12, front elevation views of a hinged greeting card 100 with an integrated electronic component 400 are provided in accordance with an embodiment of the present invention. More specifically, FIG. 11 shows the card 100 of FIG. 1 opened from right to left and in a generally fully opened first position and FIG. 12 shows the card 100 of FIG. 1 opened from left to right and in a generally fully opened second position. The electronic module 401 is affixed to the band base 302, either on the band base first side 324 or on the band base second side 326, or portions on both sides (as in the illustrated embodiment).

By way of example, the electronic module 401 is attached to the band base 302 on its first side 324. The electronic module 401 may be affixed by any means known (e.g., glue, bonding agent, tape, etc.). When affixed to the band base 302, it is ensured that the electronic module does not completely cover the aperture 314. The electronic module 401 has the first switch 402 with the first trigger 406 and the first slider 408) and the second switch 404 with the second trigger 410 and the second slider 412. In an embodiment when the electronic module 401 is affixed the first side 324 of the band base 302, the first switch may also be affixed to the same side. The first slider 408 extends from the first trigger 406 and is affixed to the front panel 102, in this configuration. The second switch 404 is slipped through the aperture 314 and affixed to the second side 326 of the band base 302. Accordingly, wires of the electronic module may pass through the aperture 314, thereby allowing the first switch 402 to be on one side of the band base 302 and the second switch 404 to be on the other side of the band base 302.

The second slider 412 extends from the second trigger 410 and is affixed to the back panel 104 (e.g., by an attachment tab 414). Thus, when the card is opened from left to right, as depicted in FIG. 12, the first slider 408 can trigger the first trigger 406 and activate the electronic module 401, such that a playback is initiated and the electronic module 401 plays a first audio file. However, when the card is opened from right to left, as depicted in FIG. 11, the second slider 412 can trigger the second trigger 410 and activate the electronic module 401, such that a playback is initiated and the electronic module 401 plays a second audio file. Thus an electronic module may be integrated with the connection band and enclosed by the flaps of the connection band that has two separate switches which trigger a single electronic module. It will be understood that the electronic module may have one or more of an audio component, a visual (i.e., light) component, and a motion component. Further, the each switch may activate the first audio file, the second audio file, the same audio file or multiple audio files.

The connecting band 108 cooperates with the window 112 to present different images "inside" the card, depending on the direction the card is opened. When the card is opened from right to left (as in FIG. 11), a first interior image is revealed. When the card is opened from left to right (as in FIG. 12), a second interior image is revealed. This is done by the band 108 and intermediary panel 106 covering different portions of the card body depending on the direction the card is opened. Whether opened right to left or left to right, the band 106 covers a middle section (e.g., a middle one third (⅓)) of one side of the interior and the intermediary panel 106 covers a top section and a bottom section (e.g., a top one third and a bottom one third) on the opposite side. Images are printed on the panels and band such that they align and cooperate to present an overall cohesive and unitary image on both inside displays of the card despite being comprised of three image portions on the left interior side and three image portions on the right interior side (i.e., six image segments (three on each side) cooperate to form each inside display).

Many variations can be made to the illustrated embodiment of the present invention without departing from the scope of the present invention. Such modifications are within the scope of the present invention. For example, any of the card body or the connecting band may be replaced with a similarly foldable substrate such as synthetic paper, PET, or any other thermoplastic polymer or fiber made therefrom. Other modifications would be readily apparent to one of ordinary skill in the art, but would not depart from the scope of the present invention. For example, instead of being opened from right to left and left to right, messages may be printed on the front such that one message is printed on an upper half of the card right side up and another message is printed on a lower half upside down. This would allow the user to rotate the card 180° and still open it right to left, but get a different interior (and a different response or audio message). In that arrangement, the image segments that form the second interior image would need to be printed upside down when compared to the image segments that form the first interior image.

From the foregoing it will be seen that this invention is one well adapted to attain all ends and objects hereinabove set forth together with the other advantages which are obvious and which are inherent to the structure. It will be understood that certain features and subcombinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings herein without departing from the essential scope thereof. Therefore, it is intended that the invention not be limited to any particular embodiment disclosed, but that the invention will include all embodiments falling within the scope of the claims.

What is claimed is:

1. A greeting card with an electronic component, the greeting card comprising:

a card body having a plurality of panels, wherein one of the panels is a front panel and one of the panels is a back panel;

a connecting band, wherein the connecting band connects the front panel to the back panel, such that the greeting card can open from right to left or from left to right; and an electronic component, wherein the electronic component is integrated with the connecting band and comprises at least one switch connected to the front panel and at least one switch connected to the back panel.

2. The greeting card of claim 1, wherein the greeting card is in a first open position when the greeting card is opened from right to left and the front panel and the back panel are not generally parallel, and wherein the greeting card is in a second open position when the greeting card is opened from left to right and the front panel and the back panel are not generally parallel.

3. The greeting card of claim 1, wherein the card body includes a third panel.

4. The greeting card of claim 3, wherein the third panel includes a window configured to receive the connecting band, and wherein the connecting band is affixed to at least a portion the front panel, extends through the window, and is affixed to at least a portion of the back panel.

5. The greeting card of claim 3, wherein the electronic component comprises an audio playback device.

6. The greeting card of claim 5, wherein a first audio file is played when the card is in the first open position.

7. The greeting card of claim 6, wherein a second audio file is played when the card is in the second open position.

8. The greeting card of claim 4, wherein the connecting band comprises a band base, and wherein a single audio playback device is affixed to one side of the band base.

9. The greeting card of claim 8, wherein the band base has an aperture.

10. The greeting card of claim 9, wherein at least one of the first switch, the second switch, or wires connecting the first or second switch to the single audio playback device extends through the aperture.

11. A greeting card greeting comprising:

a card body having a plurality of panels connected together, wherein one of the panels is a front panel, one of the panels is a back panel, and one of the panels is an intermediary panel, and wherein the intermediary panel connects the front panel to the back panel;

a connecting band, wherein the connecting band connects the front panel to the back panel, such that the greeting card can open from right to left or from left to right; and an electronic component, wherein the electronic component includes a first switch connected to and activated by the front panel and a second switch connected to and activated by the back panel.

12. The greeting card of claim 11, wherein the connecting band comprises a band base and a plurality of flaps.

13. The greeting card of claim 12, wherein the electronic component is affixed to one of a first side or a second side of the band base and is covered by a flap.

14. The greeting card of claim 13, wherein the band base has an aperture therethrough.

15. The greeting card of claim 14, wherein one of the first switch or the second switch or wires thereof extend through the aperture.

16. The greeting card of claim 15, wherein a portion of the first switch is affixed to the front panel and a portion of the second switch is affixed to the back panel.

17. The greeting card of claim 16, wherein the greeting card is in a first open position when the greeting card is opened from right to left and the front panel and the back panel are not generally parallel, and wherein the greeting card is in a second open position when the greeting card is opened from left to right and the front panel and the back panel are not generally parallel.

18. The greeting card of claim 17, wherein the electronic component is a sound module and wherein the sound module can store a plurality of audio files.

19. The greeting card of claim 18, wherein the first switch initiates a first audio playback when the greeting card is in the first open position.

20. The greeting card of claim 19, wherein the second switch initiates a second audio playback when the greeting card is in the second open position.

* * * * *